United States Patent [19]

Schweisser et al.

[11] 4,155,304

[45] May 22, 1979

[54] DEVICE FOR PROVIDING THE INKING SYSTEM OF PRINTING PRESSES WITH INK

[75] Inventors: Wolfgang Schweisser, Hausen; Manfred Fuchs, Offenbach-Burgel, both of Fed. Rep. of Germany

[73] Assignee: Roland Offsetmaschinenfabrik Faber & Schleicher AG, Fed. Rep. of Germany

[21] Appl. No.: 892,909

[22] Filed: Apr. 3, 1978

[30] Foreign Application Priority Data

Apr. 1, 1977 [DE] Fed. Rep. of Germany ..... 2714611

[51] Int. Cl.[2] ..... B41F 31/08; B65D 47/34

[52] U.S. Cl. ..... 101/366; 222/81; 222/95

[58] Field of Search ..... 101/366, 364, 350, 207, 101/208, 210, 335, 363; 222/325, 326, 327, 309, 390, 81, 80, 82, 87, 95, 96, 103; 401/152, 153, 164

[56] References Cited

U.S. PATENT DOCUMENTS

| | | | |
|---|---|---|---|
| 1,687,014 | 10/1928 | Gatchell | 222/327 X |
| 2,131,487 | 9/1938 | Tear | 222/327 X |
| 2,778,541 | 1/1957 | Sherbondy | 222/327 |
| 2,822,959 | 2/1958 | Soehnlen et al. | 222/327 |
| 2,993,439 | 7/1961 | Rohrer | 101/247 |
| 2,998,767 | 9/1961 | Vandercook et al. | 101/366 X |
| 3,104,031 | 9/1963 | Wagner | 222/327 X |
| 3,130,872 | 4/1964 | Myers et al. | 222/327 X |
| 3,193,146 | 7/1965 | Isgriggs et al. | 222/326 X |
| 3,199,451 | 8/1965 | Nitchie | 101/366 |
| 3,345,943 | 10/1967 | Rakowicz et al. | 101/366 |
| 3,904,083 | 9/1975 | Little | 222/326 X |

FOREIGN PATENT DOCUMENTS

| | | | |
|---|---|---|---|
| 2401479 | 7/1975 | Fed. Rep. of Germany | 222/390 |

*Primary Examiner*—J. Reed Fisher

*Attorney, Agent, or Firm*—Leydig, Voit, Osann, Mayer & Holt, Ltd.

[57] ABSTRACT

A device for loading an ink fountain of a printing press directly from sealed cans of ink. The device includes a base plate having a pair of vertical threaded pillars laterally spaced to define a working area adequate to accommodate cans of ink in all normally available sizes. A pressure plate flatly superimposed above the working area has captive bushings which threadedly engage the pillars, the bushings being rotated in unison for lowering the pressure plate to the base plate. An aperture is generally centered in the base plate. Thus when the base plate is seated above the fountain and a can of ink having a puncture alined with the aperture is engaged between the pressure plate and the base plate, ink is squeezed through the aperture directly into the fountain accompanied by accordion type collapse of the can into empty flattened condition.

6 Claims, 3 Drawing Figures

DEVICE FOR PROVIDING THE INKING SYSTEM OF PRINTING PRESSES WITH INK

The ink used in a printing press is generally furnished by the manufacturer in metal cans having a metal cover which is sealed by a strip of adhesive tape. Under the cover is an additional protective layer of waxed paper, plastic or foil. In transferring the ink to the ink fountain in the usual way it is necessary to remove the tape, pry off the cover and to remove the protective layer. The exposed surface of the ink is then carefully inspected for the presence of a dried surface or skin which may exist on ink which is not fresh and which, if present, must be carefully removed with a spatula. The ink, because of its pastey consistency, must be manually scooped into the fountain and residual ink is often left in the can and thus wasted. As presently carried out, loading a fountain is a time consuming chore distasteful to every pressman. In addition, the discarded cans, because of their volume and because of their soiling with ink, create a disposal problem.

Some effort has been made in the past to speed up the loading operation, for example as taught in German laid-open specification DT-OS 2,011,702. In the disclosed device ink is discharged from a can by cutting a hole in the bottom of the can, removing the cover and engaging the mass of ink in the can by means of a fitted piston. Such a procedure, however, has inherent disadvantages which have prevented it from coming into common usage. In the first place the adhesive sealing strip and cover must be removed, which is, itself, a time consuming operation. Secondly, the device is limited to one size of can and, even so, it is difficult to get a snug fit between the wall of the can and the piston so that leakage and wasteage may occur. During the course of emptying the can the piston is contaminated and must be carefully cleaned before the device can be used for ink of different color. When set-up time and cleaning time is included there is no net saving of time over the usual manual procedure and the empty cans continue to present a disposal problem.

It is, accordingly, an object of the present invention to provide a device for loading an ink fountain which is both quick and convenient. It is another object to provide a loading device which does not require a can of ink to be opened and in which it suffices to place the can between a base plate and pressure plate with application of power to secure prompt and complete discharge of the contents free of contamination of the discharged ink by dried skins or other impurities and free of contamination of the outside of the can or the loading device itself. Thus the device may be used on a portable basis to supply ink fountains with different colors of inks in quick succession without necessity for time consuming clean-up.

It is another object of the invention to provide an ink loading device which may be universally employed for all ink cans or containers in sizes normally available in the marketplace without necessity for modification or adjusting to size.

It is another object to provide an ink loading device in which there is no danger of ink leakage and in which the cans are completely emptied, thereby avoiding any wasteage of residual ink, with the cans themselves, regardless of size, being compacted accordion fashion into flat disc shape for convenient disposal in clean condition.

It is an object of the invention in one of its aspects to provide an ink loading device which includes a puncturing member for automatic puncturing in proper position for discharge without necessity for accurate location of the can within the device or the exercise of any other special care or attention on the part of the pressman.

It is yet another object to provide a device for loading of an ink fountain which is simple and economical, inherently durable and long-lived.

Other objects and advantages of the invention will become apparent upon reading the attached detailed description and upon reference to the drawing in which.

Figures 1, 2, 3:
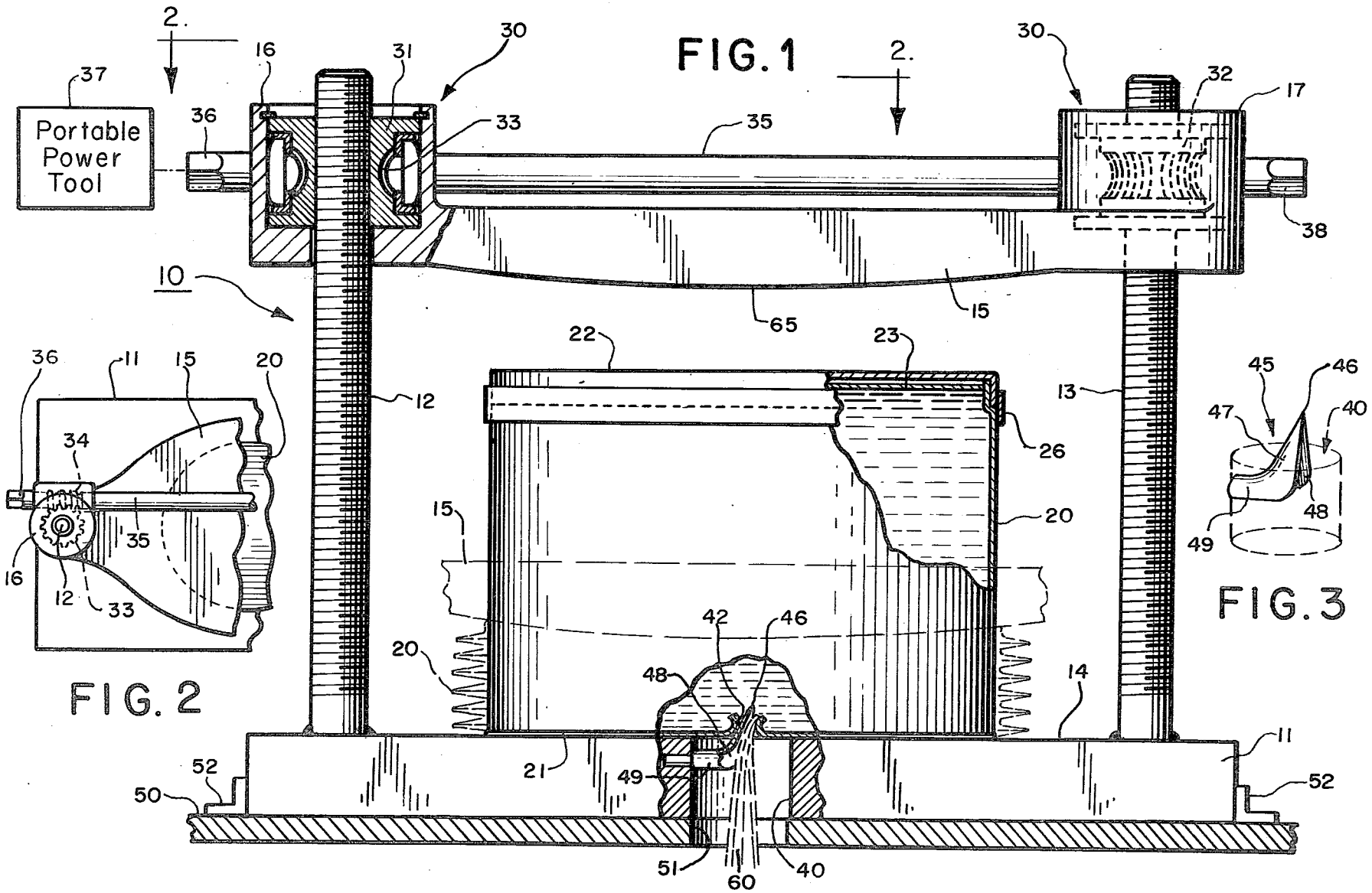
FIG. 1 is a side elevation, in partial section, of an ink loading device constructed in accordance with the invention.
FIG. 2 is a fragmentary top view looking along line 2—2 in FIG. 1.
FIG. 3 is an enlarged perspective view of the puncturing member.

While the invention has been described in connection with a preferred embodiment, it will be understood that we do not intend to be limited to the particular embodiment shown but intend, on the contrary, to cover the various alternative and equivalent constructions covered within the spirit and scope of the appended claims.

Turning now to the drawing there is disclosed in FIG. 1 a loading device 10 having a base plate 11 with upstanding pillars 12, 13 welding thereto, the pillars being laterally spaced to provide a working area 14. Superimposed above the working area is a pressure plate 15 having sockets 16, 17 for telescoped engagement with the pillars 12, 13. As will be described, a manually controlled driving mechanism is provided for moving the pressure plate downwardly with powerful squeezing action and for subsequently raising the pressure plate.

Prior to discussing such operating mechanism, attention may be given to the ink container which is to be acted upon. As conventionally supplied by ink manufacturers, the container is in the form of a thin walled can 20 of cylindrical shape having a bottom, or lower end wall, 21 and a fitted cover 22. Under the cover is a thin protective layer 23 in the form of waxed paper, plastic or foil which serves to inhibit the drying or "skinning" of the body of ink 25. Encircling the joint between the cover and body of the can is a layer of durable adhesive tape 26.

In accordance with the present invention an aperture is generally centered in the base plate and powered, manually-controlled driving means is interposed between the pillars and the pressure plate for lowering the pressure plate parallel to the base plate, so that when the base plate is seated above the fountain and a can of ink having a puncture alined with the aperture is engaged between the pressure plate and the base plate, ink is squeezed through the aperture directly into the fountain accompanied by accordion type collapse of the can into empty flattened condition.

In the present instance the pillars 12, 13 are threaded and the driving means, generally indicated at 30, includes rotatable threaded bushings, or nuts, 31, 32 held captive in the sockets 16, 17 on the pressure plate. Taking the bushing 31 as representative, it has a worm wheel 33 formed in its outer surface and is engaged by a worm 34 formed on a drive shaft 35. The shaft has a drive connection 36 at its adjacent end which is squared or otherwise specially shaped for engagement of a portable power tool generally indicated at 37, the power tool preferably being of the reversible type for both upward and downward movement. However, if desired, the opposite end of the shaft 35 may be similarly shaped for driving purposes, as indicated at 38, to achieve both upward and downward movement by a unidirectional driving tool.

For direct downward discharge of the ink from the can, an aperture 40 is provided in the base plate in a generally central position. Before squeezing pressure is applied to the can, the can is punctured to provide an opening 42, either manually or by automatic means to be described. It is preferred to puncture the can automatically by a puncturing member on the base plate alined with the aperture 40. The puncturing member 45, illustrated in detail in FIG. 3, has a pointed tip 46 and a tapering body 47 formed with an adjacent hollow 48. The body is supported upon a neck 49 which is preferably mounted cantilever-fashion in the wall of the aperture 40. The purpose of the hollow 48 is to enable relatively unobstructed passage of ink even though the member 45 is in its seated, puncturing condition in the can. This condition is illustrated in FIG. 1 in which it will be noted that the tip 46 projects upwardly from the base plate 14 and well into the body of the ink. Where the tip projects upwardly an appreciable distance in order to maximize the discharge opening, a registering recess may be provided in the pressure plate. Alternatively, provision may be made for slight retreating of the puncturing member with respect to the base plate at the end of the collapsing movement. For this purpose the neck 49 of the puncturing member may be made stiffly resilient, for restoration to normal position when the compressive force is backed off.

Having understood the construction of the loading device a typical sequence of operation may be considered. The device, as mentioned, is portable and of relatively light construction so that it may be seated above the fountain into which the ink is to be discharged. For example, the device may be seated upon the lid 50 of an ink trough, the lid, if desired, being provided with a receiving opening 51 and with alignment of the opening 51 with the aperture 40 being facilitated by locating surfaces 52.

With the pressure plate 15 fully upraised, a can 20 is seated in the working area 14. The can may be of any size and need not be precisely centered. A portable power tool 37 is then engaged with the drive connection 36 to rotate the drive shaft 35 for turning of the threaded bushings 31, 32, with a high mechanical advantage being achieved by use of the worm wheel 33 and worm 34.

As the pressure plate 15 applies pressure to the top of the can, the reaction force pushes the can down against the puncturing member 45 to form a discharge opening, the can thereafter seating firmly on the base plate. Continued downward movement of the pressure plate 15 progressively collapses the side wall of the can in random accordion-pleated fashion causing the ink to be forcibly discharged downwardly in a stream 60 through the opening 51 and into the trough. As shown in FIGS. 1 and 2, the working area is free of any lateral confinement of the can and the pressure plate and base plate are both dimensioned to extend laterally beyond the can in all directions so that pressure is applied uniformly about the periphery of the can thereby to encourage the accordion-type deformation.

It is found, surprisingly enough, that with the cover 22 and encircling tape 26 left intact, the cover does not tend to give way and the body of the can does not suffer any localized deformation of a type which might induce bursting. Instead, the flattening progresses uniformly until the pressure plate bottoms with respect to the base plate accompanied by a substantially total emptying of the contents. As the bottoming condition is approached the tip of the puncturing member is engaged and, as the movement is completed, the puncturing member is accommodated in its recess or resiiently retreats downwardly to avoid deformation or breakage.

The flange of the cover, while strong enough to resist giving way during the course of the downward stroke is, nevertheless, sufficiently deformable so as to flatten out at the end of the stroke so that it does not add appreciably to the final thickness of the collapsed metal. In order to insure substantially complete emptying of the can, while accommodating the thickness of metal in the collapsed wall, the pressure plate preferably is formed with a convex undersurface as indicated at 65.

When discharge is complete, the direction of rotation of the drive shaft 35 is reversed restoring the pressure plate to its upraised position, after which the can, collapsed into flat disc shape, uncontaminated by ink, and hence easily handled, is removed and discarded, occupying a volume which is but a small fraction of the original.

It is seen that the device described above amply fulfills the objects of the invention. The can need not be prepared for opening by removal of tape, cover or protective layer but may be simply deposited in the working area, regardless of size. Puncturing is automatic and it takes but a short time to drive the pressure plate to the end of its stroke by means of a light portable power tool. Since the ink is ejected centrally of the aperture 40 in a narrow stream, ink does not tend to collect on the device and the device may be moved promptly, without intermediate cleaning, between fountains of different color. In the event that any drop of ink should soil the wall of the aperture, and for the purpose of insuring cleanliness of the puncturing member, especially when going from a darker to a lighter color, a cleaning rag, dampened with solvent, if desired, may be passed through the aperture.

The mode of discharge insures that only ink of the desired pastey consistency will escape; ink which has hardened or which has formed a skin is retained in the can and thus harmlessly disposed of without care or attention.

Use of the invention not only results in cleanliness thoroughness and a saving of time but is removes any unpleasantness previously associated with the job.

While the invention has been described in connection with a metal can, the term "can" shall be understood to include other equivalent types of containers. The term "sealed" refers to a container which is leakproof in the face of applied pressure. Ther term "generally centered" as applied to the aperture in the base means occupying a sufficiently central position as will insure register with the bottom of the container.

What we claim is:

1. A device for loading an ink fountain of a printing press from sealed cans of ink having parallel end surfaces and a continuous cylindrical wall made of thin axially collapsible material comprising, in combination, a base plate having vertical pillars secured thereto and laterally spaced to provide a flat working area free of lateral confinement and adequate to accommodate cans of ink of normally available size, a pressure plate flatly superimposed above the working area and supported on said pillars, the pressure plate and base plate being dimensioned to extend laterally beyond the can in all directions, the base plate having an aperture generally centered therein, a manually controlled driving means interposed between the pillars and the pressure plate for lowering the pressure plate parallel to the base plate so that when the base plate is seated above the fountain and a can of ink having a puncture aligned with the aperture is engaged between the pressure plate and the base plate, ink is squeezed through the aperture directly into the fountain accompanied by accordion-type collapse of the can to empty flattened condition.

2. The combination as claimed in claim 1 in which the undersurface of the pressure plate is convex for bringing the ends of the can into completely emptying contact notwithstanding the presence of the collapsed wall of the can.

3. A device for loading an ink fountain of a printing press from sealed cans of ink having parallel end surfaces and a continuous cylindrical wall made of thin axially collapsible material comprising, in combination, a base plate having vertical pillars secured thereto and laterally spaced to provide a flat working area free of lateral confinement and adequate to accommodate cans of ink of normally available size, a pressure plate flatly superimposed above the working area and supported on said pillars, the pressure plate and base plate being dimensioned to extend laterally beyond the can in all directions, the base plate having an aperture generally centered therein, a manually controlled driving means interposed between the pillars and the pressure plate for lowering the pressure plate parallel to the base plate, a puncturing member secured to the base plate within the aperture and having a tip extending upwardly from the base plate, so that when the base plate is seated above the fountain and a can of ink is engaged between the pressure plate and the base plate, the can is punctured and ink is squeezed through the aperture directly into the fountain accompanied by accordion-type collapse of the can into empty flattened condition.

4. The combination as claimed in claim 3 in which the puncturing means has a resilient mounting portion which is so stiffly resilient as to achieve puncturing but which undergoes automatic retreating movement after the can is empty and as the pressure plate approaches a bottoming condition with respect to the base plate.

5. A device for loading an ink fountain of a printing press from sealed cans of ink having parallel end surfaces and a continuous cylindrical wall made of thin axially collapsible material comprising, in combination, a base plate having a pair of vertical threaded pillars secured thereto laterally spaced to define a flat working area free of lateral confinement and adequate to accommodate cans of ink of normally available size, a pressure plate flatly superimposed above the working area and having captive threaded bushings threadedly engaging the pillars, the pressure plate and base plate being dimensioned to extend laterally beyond the can in all directions, the base plate having an aperture generally centered therein, driving means for rotating the bushings in unison for lowering the pressure plate parallel to the base plate so that when the base plate is seated above the fountain and a can of ink having a puncture aligned with the aperture is engaged between the pressure plate and the base plate, ink is squeezed through the aperture directly into the fountain accompanied by accordion-type collapse of the can into empty flattened condition.

6. The combination as claimed in claim 5 in which the bushings have worm wheels thereon and in which the driving means includes a drive shaft having worms in engagement with the worm wheels, drive connections being provided at opposite ends of the drive shaft for driving the shaft in opposite directions upon engagement by a unidirectional power tool.

* * * * *